US011628484B2

(12) United States Patent
Matsutani et al.

(10) Patent No.: US 11,628,484 B2
(45) Date of Patent: Apr. 18, 2023

(54) PRESS FORMING METHOD

(71) Applicant: HONDA MOTOR CO., LTD., Tokyo (JP)

(72) Inventors: Kenji Matsutani, Tochigi-ken (JP); Hirokatsu Akiba, Tochigi-ken (JP); Takeshi Sano, Tochigi-ken (JP); Yoshitake Omiya, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/440,214

(22) PCT Filed: Mar. 3, 2020

(86) PCT No.: PCT/JP2020/008795
§ 371 (c)(1),
(2) Date: Sep. 17, 2021

(87) PCT Pub. No.: WO2020/195593
PCT Pub. Date: Oct. 1, 2020

(65) Prior Publication Data

US 2022/0143671 A1 May 12, 2022

(30) Foreign Application Priority Data

Mar. 28, 2019 (JP) ..... JP2019-063228

(51) Int. Cl.
*B21D 22/26* (2006.01)
*B21D 53/88* (2006.01)

(52) U.S. Cl.
CPC ..... *B21D 22/26* (2013.01); *B21D 53/88* (2013.01)

(58) Field of Classification Search
CPC ..... B21D 24/10; B21D 53/88; B21D 22/26
See application file for complete search history.

(56) References Cited

U.S. PATENT DOCUMENTS 8,051,696 B2 * 11/2011 Yoshida ..... B21D 22/22 72/347
8,429,946 B2 * 4/2013 Maeda ..... B21D 22/02 72/453.13

(Continued)

FOREIGN PATENT DOCUMENTS

CN 107708884 2/2018
JP 62-057406 12/1987

(Continued)

OTHER PUBLICATIONS

JP-2017030038-A Machine Translation (Year: 2017).*

(Continued)

*Primary Examiner* — Michael W Hotchkiss
(74) *Attorney, Agent, or Firm* — Amin, Turocy & Watson, LLP

(57) ABSTRACT

This press forming method includes a first drawing step for forming a first drawn step portion, a second drawing step for forming a second drawn step portion, and a finishing step for completing a stepped portion. In the first drawing step, a first outside curved portion is formed to the outside of a second outside curved portion with respect to an extension region of a character line, and a first parallel portion is formed to the same depth as the drawn depth of a second parallel portion. In the second drawing step, a second inside curved portion having a greater curvature than a first inside curved portion is formed.

6 Claims, 7 Drawing Sheets

(56) References Cited

U.S. PATENT DOCUMENTS

| | | | | |
|---|---|---|---|---|
| 2006/0090530 | A1* | 5/2006 | Hammer | B21D 22/26 72/75 |
| 2019/0217688 | A1* | 7/2019 | Amano | B21D 22/02 |
| 2021/0220897 | A1* | 7/2021 | Sawa | B21D 28/26 |

FOREIGN PATENT DOCUMENTS

| | | | | |
|---|---|---|---|---|
| JP | 2009-056491 | | 3/2009 | |
| JP | 2017-030038 | | 2/2017 | |
| JP | 2017030038 | A * | 2/2017 | |
| WO | WO-2018168311 | A1 * | 9/2018 | B21D 24/04 |

OTHER PUBLICATIONS

WO-2018168311-A1 Machine Translation (Year: 2018).*
Indian Office Action for Indian Patent Application No. 202147048887 dated Mar. 2, 2022.
International Search Report and Written Opinion for International Application No. PCT/JP2020/008795 dated Jun. 9, 2020, 8 pages.
Chinese Office Action and Search Report for Chinese Patent Application No. 202080024935.7 dated Dec. 28, 2022.

* cited by examiner

PRESS FORMING METHOD

TECHNICAL FIELD

The present invention relates to a press forming method for forming a stepped portion on a workpiece having a character line.

BACKGROUND ART

An outer panel of an automobile door is formed in a manner that an outer peripheral edge portion is inwardly folded with respect to a main body portion that makes up the external appearance of the automobile (see JP S62-057406 B). For example, on a front side of a rear door, a step portion is provided that overlaps with a boundary or edge portion on a rear side of a front door. Such a step portion prevents the front door from entering inside the cabin and making it impossible for the door to be opened when another automobile collides with a side surface of the automobile.

SUMMARY OF INVENTION

Incidentally, among such automobiles, there are ones having a sharp character line (ridgeline) designed on an outer panel of a door. In the case that such a character line is formed, and a stepped portion is press formed, a problem arises in that wrinkles are likely to occur, because a sandwiching angle sandwiching the character line therein is small. In order to suppress the occurrence of such wrinkles, it may be considered to increase the elongation of the plate material at a time of draw forming. However, in this case, a different problem arises in that cracking is likely to occur in the stepped portion. Wrinkles or cracking that occur on the outer panel lead to a deterioration in the appearance of the outer panel, and such a deterioration in appearance cannot be applied as a product.

The present invention has been devised to solve the aforementioned problems, and has the object of providing a press forming method which is capable of significantly improving yield at a time of manufacturing, by satisfactorily suppressing the occurrence of wrinkles or cracking when a stepped portion is formed on a panel having a character line.

In order to achieve the aforementioned object, the present invention is characterized by a press forming method for forming a stepped portion on an end part of a main body portion including a character line, the press forming method comprising a first drawing step of forming, by a drawing process, a first drawn stepped portion from a workpiece including the character line, the first drawn stepped portion including a first inclined portion connected to the main body portion via a first outside curved portion, and a first parallel portion connected to the first inclined portion via a first inside curved portion and extending in parallel with the main body portion, after the first drawing step, a second drawing step of forming, by a drawing process, a second drawn stepped portion from the first drawn stepped portion, the second drawn stepped portion including a second inclined portion connected to the main body portion via a second outside curved portion, and a second parallel portion connected to the second inclined portion via a second inside curved portion and extending in parallel with the main body portion, and after the second drawing step, a finishing step of finishing the stepped portion, wherein, in the first drawing step, in an extended region positioned on an extension line of the character line, the first outside curved portion is formed on a more outer side than the second outside curved portion, and the first parallel portion is formed at a same depth as a drawing depth of the second parallel portion, and in the second drawing step, the second inside curved portion having a greater curvature than that of the first inside curved portion is formed in the extended region.

According to the above-described press forming method, by carrying out the first and second drawing steps, even at the end part of the main body portion including the character line, the stepped portion can be satisfactorily formed without causing wrinkles or cracking to occur. Stated otherwise, since the position of the first outside curved portion formed in the first drawing step, and the position of the second outside curved portion formed in the second drawing step are shifted, it is possible to prevent a specified location of the plate material from becoming extremely thin in the extended region. Therefore, occurrence of cracking in the extended region is suppressed. Further, the first parallel portion formed in the first drawing step is formed at the same depth as the second parallel portion, and the curvature of the second inside curved portion is formed with a large curvature in the second drawing step, whereby in the second drawing step, the second inside curved portion can be made closer to the stepped portion in its completed form. Thus, in the finishing step, shrinkage of the second inside curved portion becomes small, and the occurrence of wrinkles in the extended region is suppressed. Accordingly, the press forming method is capable of significantly improving yield at the time of manufacturing.

DESCRIPTION OF EMBODIMENTS

Hereinafter, a preferred embodiment of the present invention will be presented and described in detail below with reference to the accompanying drawings.

Figure 1A:
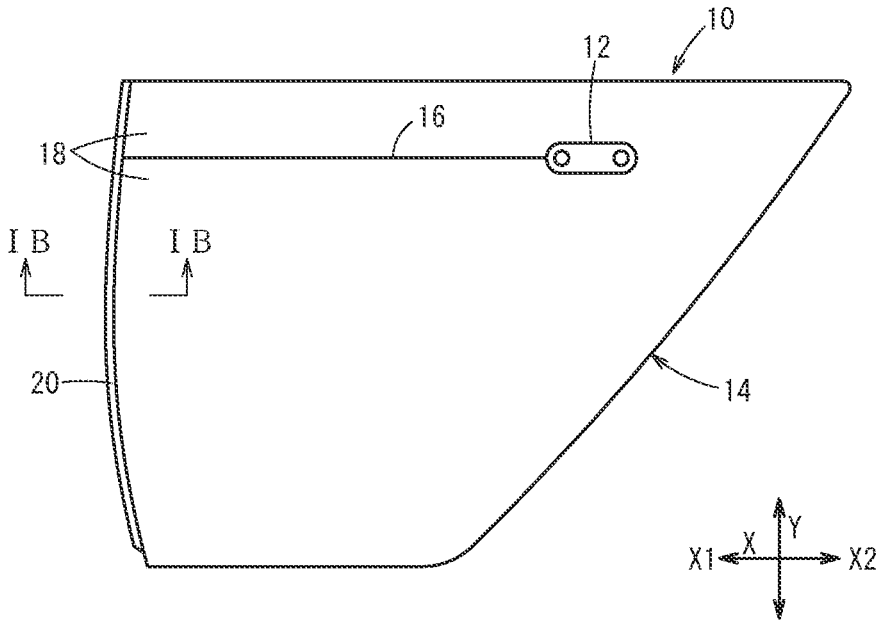
FIG. 1A is a plan view showing an outer panel of a rear door formed by a press forming method according to an embodiment of the present invention.

In the press forming method according to an embodiment of the present invention, as shown in FIG. 1A, an outer panel 10 of a rear door of an automobile is formed. The outer panel 10 is formed in a substantially trapezoidal shape, which is elongated in a front-rear direction of the automobile (a vehicle lengthwise direction: the direction of the arrow X), and is short in a heightwise direction of the automobile (a vertical direction: the direction of the arrow Y), and the lower portion of which on a rearward side (the side of the arrow X2) is inclined.

The outer panel 10 includes a main body portion 14 exposed to an outer side of the automobile (making up the external appearance of the rear door). A doorknob arrangement portion 12 on which a non-illustrated doorknob is installed is formed in proximity to a rear side of the main body portion 14. Further, on the surface of the main body portion 14, a sharp character line 16 (ridgeline) of the automobile is formed at a predetermined position (a position at the same height as the doorknob arrangement portion 12) in the direction of the arrow Y. The character line 16 is raised from smooth surface portions 18 that are smoothly formed in the direction of the arrow Y (in a vertical direction) of the character line 16, and extends in a substantially linear shape along the direction of the arrow X. Stated otherwise, a sandwiching angle on the rear surface side of the pair of smooth surface portions 18 sandwiching the character line 16 is formed to be less than 180°.

Further, the outer panel 10 is equipped with a stepped portion 20 at the end on the front side (the side of the arrow X1 in FIG. 1A) of the main body portion 14. The stepped portion 20 serves as a portion that overlaps (is superimposed on) the rearward side of the front door in an assembled state of the automobile. The stepped portion 20 is formed over substantially the entire length in the direction of the arrow Y, and in addition, is provided at a location where the character line 16 is formed. Following the main body portion 14, the stepped portion 20 also extends in a hill like (curved) shape in the direction of the arrow Y, with a portion thereof, which is positioned on an extension line of the character line 16, serving as a reference line.

Figure 1B:
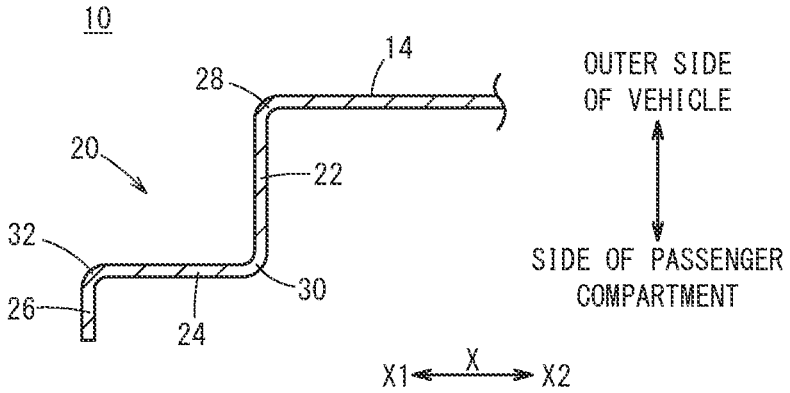
FIG. 1B is a cross-sectional view taken along line IB-IB of FIG. 1A.

As viewed in cross section along the direction of the arrow X shown in FIG. 1B, the stepped portion 20 of the outer panel 10 includes a first orthogonal portion 22 that is bent from the main body portion 14 toward the side of the passenger compartment, a parallel portion 24 that extends in the direction of the arrow X from the first orthogonal portion 22, and a second orthogonal portion 26 that is bent further toward the side of the passenger compartment from the parallel portion 24. The first orthogonal portion 22 is longer than the second orthogonal portion 26.

An outside corner portion 28 between the main body portion 14 and the first orthogonal portion 22 constitutes a boundary between an outside exposed portion of the outer panel 10 and a portion that is hidden by the front door, and is formed into a rounded corner having a large curvature. On the other hand, an inside inner peripheral corner portion 30 between the first orthogonal portion 22 and the parallel portion 24 is formed into a rounded corner having a curvature that is smaller than that of the outside corner portion 28. Furthermore, an inside outer peripheral corner portion 32 between the parallel portion 24 and the second orthogonal portion 26 is formed into a rounded corner of the same degree of curvature as that of the outside corner portion 28.

Figure 2:
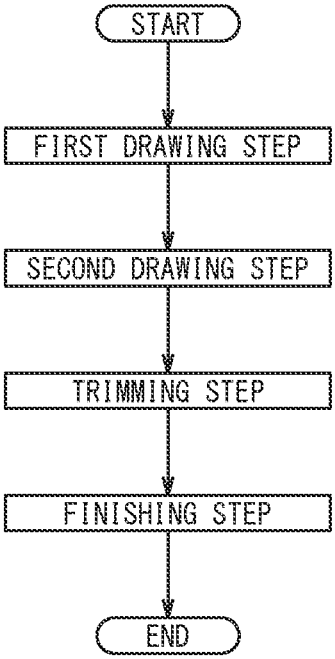
FIG. 2 is a flowchart showing process steps of a manufacturing method.

In the process steps shown in FIG. 2, by the aforementioned outer panel 10 being subjected to press forming, a stepped portion forming process for forming the stepped portion 20 is carried out, while at the same time a main body portion forming process for forming the main body portion 14 having the character line 16 is carried out.

In the main body portion forming process, in a first drawing step, an intermediate formed body (not shown), which has an intermediate ridgeline portion with a radius of curvature larger than the radius of curvature of the character line 16 intended to be formed, is press formed from a plate material. Then, in a second drawing step after the first drawing step, a target formed body (the main body portion 14) is press formed from the intermediate formed body.

In this instance, the intermediate formed body formed during the first drawing step may be formed so as to include coincident regions where the cross-sectional shape thereof coincides with the shape of the target formed body on both sides of the intermediate ridgeline portion, and an intermediate region where the cross-sectional shape thereof does not coincide with the shape of the target formed body. In accordance with this feature, in the second drawing step, the constituent material of the intermediate formed body, which is insufficient in the character line 16, can be supplied to the intermediate formed portion from both sides of the intermediate ridgeline portion, and scratches or cracking in the vicinity of the character line 16 can be suppressed.

Then, in the stepped portion forming process, a first drawn stepped portion 40 is formed by the first drawing step, and a second drawn stepped portion 60 is formed by the second drawing step. Furthermore, in the stepped portion forming process, after the second drawing step, a trimming step for cutting off an outer periphery of the second drawn stepped portion 60, and a finishing step for forming the stepped portion 20 in its completed form by bending or the like are sequentially performed.

In this instance, in the conventional press forming method, as was discussed previously, when the stepped portion 20 is formed on the outer panel 10 having the character line 16, there were cases in which wrinkles or cracking occurred at the location where the character line 16 was formed. With the press forming method according to the present embodiment, the occurrence of wrinkles or cracking is suppressed, by carrying out forming while the character line 16 is taken into consideration in the first drawing step and the second drawing step. Hereinafter, a description will be given in detail concerning forming of the first drawn stepped portion 40 in the first drawing step, and forming of the second drawn stepped portion 60 in the second drawing step.

Figure 3:
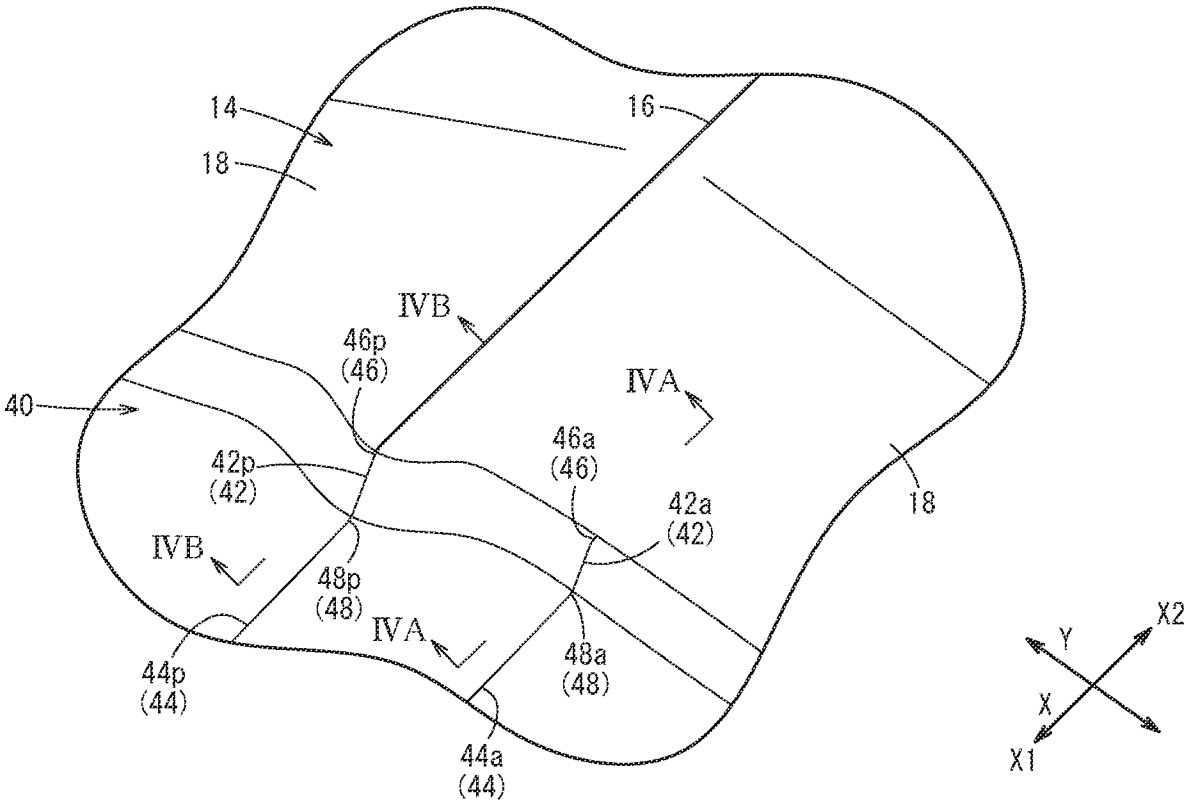
FIG. 3 is a perspective view showing a first drawn step portion formed by a first drawing step.
Figure 4A:
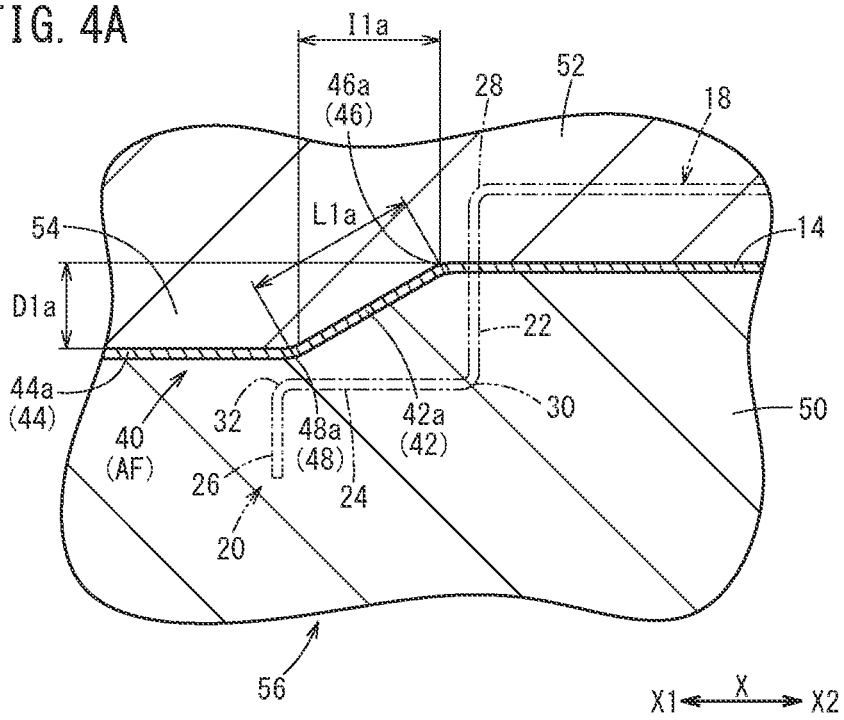
FIG. 4A is a cross-sectional view showing the first drawing step corresponding to a peripheral region taken along line IVA-IVA of FIG. 3.
Figure 4B:
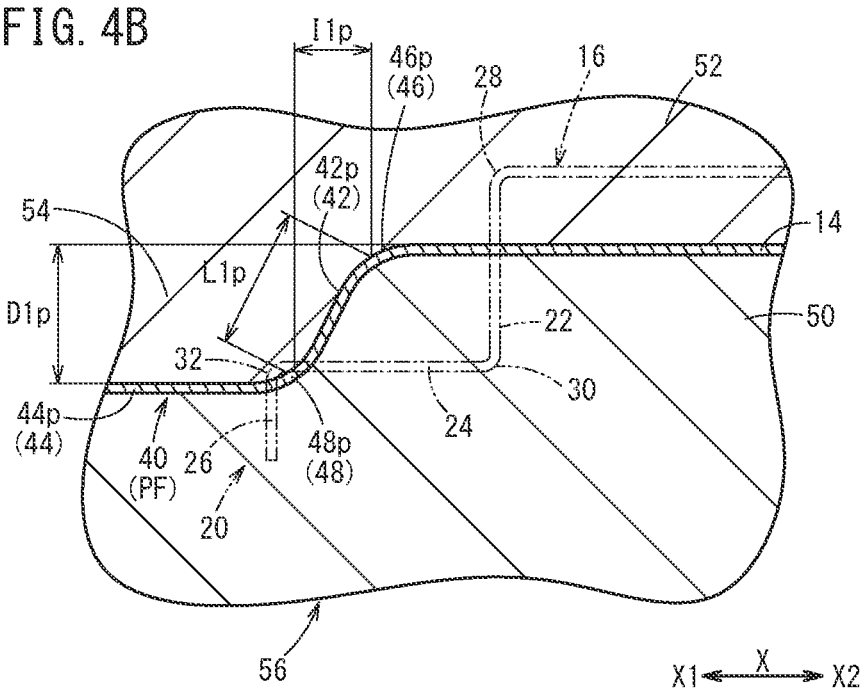
FIG. 4B is a cross-sectional view showing the first drawing step corresponding to an extended region taken along line IVB-IVB of FIG. 3.

In the first drawing step, as shown in FIGS. 3, 4A, and 4B, the first drawn stepped portion 40 is formed by subjecting, to a drawing process, an end edge of the plate material (workpiece) in which the character line 16 (intermediate ridgeline) is formed. The first drawn stepped portion 40 exhibits a shape in which a first inclined portion 42 is continuous with an outer periphery of the main body portion 14, and a first parallel portion 44 is continuous with an outer periphery of the first inclined portion 42.

A first outside curved portion 46 having a curvature sufficiently smaller than the curvature of the outside corner portion 28 of the stepped portion 20 in its completed form is formed between the outer periphery of the main body portion 14 and an inner periphery of the first inclined portion 42. Similarly, a first inside curved portion 48 having a curvature sufficiently smaller than the curvature of the inside inner peripheral corner portion 30 of the outer panel 10 in its completed form is formed between the outer periphery of the first inclined portion 42 and an inner periphery of the first parallel portion 44.

In the first drawing step, for example, there is used a manufacturing device 56 for first drawing including a punch (lower die) 50 that supports a rear surface side of the workpiece (the main body portion 14), a die (upper die) 52 that restrains a front surface side of the workpiece, and a convex die portion 54 for forming the first parallel portion 44 by pressing on the workpiece. Moreover, although illustration thereof is omitted, the workpiece, at a location on a side opposite to the main body portion 14 with the convex die portion 54 sandwiched therebetween, is also sandwiched between a die and a punch that are not illustrated.

In addition, in the first drawing step, an extended region PF positioned on the extension line of the character line 16, and a peripheral region AF, which is positioned at a periphery shifted in the direction of the arrow Y from the extended region PF, are subjected to draw forming so that the cross-sectional shapes thereof (cross sections along the direction of the arrow X) differ from each other. The peripheral region AF corresponds to a portion that is continuous with the smooth surface portions 18 of the main body portion 14. More specifically, in the manufacturing device 56 for first drawing, the planar shapes of the punch 50, the die 52, and the convex die portion 54, and the amount at which the convex die portion 54 protrudes are appropriately designed, so that the cross-sectional shape of the extended region PF and the cross-sectional shape of the peripheral region AF are made to differ. Hereinafter, respective constituent features of the stepped portion 20 positioned in the peripheral region AF will be designated by the reference character "a" being appended after the reference numerals, and respective constituent features of the stepped portion 20 positioned in the extended region PF will be designated by the reference character "p" being appended after the reference numerals.

More specifically, a first outside curved portion 46*a* of the peripheral region AF is formed at substantially the same position as the outside corner portion 28 (slightly more on the side of the arrow X1 than the outside corner portion 28) of the stepped portion 20 in its completed form. Due to the first outside curved portion 46*a*, the angle of inclination of a first inclined portion 42*a* with respect to the main body portion 14 is set to be small. A first inside curved portion 48*a* of the peripheral region AF is formed at substantially the same position as the inside outer peripheral corner portion 32 of the stepped portion 20 in its completed form. Accordingly, a drawing depth D1*a* of a first parallel portion 44*a* with respect to the smooth surface portions 18 (the main body portion 14) is made comparatively shallow.

On the other hand, a first outside curved portion 46*p* of the extended region PF is formed so as to be shifted toward the side of the arrow X1 (the outer side) from the outside corner portion 28 of the stepped portion 20 in its completed form. More specifically, the first outside curved portion 46*p* of the extended region PF is shifted toward the side of the arrow X1 from the first outside curved portion 46*a* of the peripheral region AF. Incidentally, in FIGS. 4A and 4B, the main body portion 14 (the character line 16) is positioned on a lower side of the stepped portion 20 in its completed form. This is because processing is performed at a position that is shallower than the character line 16 in the first drawing step, whereas the main body portion 14 is lifted up to the character line 16 in the second drawing step. Due to the first outside curved portion 46*p*, the angle of inclination of a first inclined portion 42*p* with respect to the main body portion 14 is set to be larger than the angle of inclination of the first inclined portion 42*a*.

Furthermore, a first inside curved portion 48*p* of the extended region PF is formed at substantially the same position as the inside outer peripheral corner portion 32 of the stepped portion 20 in its completed form. Accordingly, a drawing depth Dip of a first parallel portion 44*p* with respect to the character line 16 (the main body portion 14) is deeper than the drawing depth D1*a* of the peripheral region AF.

Further, the curvatures of the first outside curved portion 46*p* and the first inside curved portion 48*p* within the extended region PF are formed to be smaller than the curvatures of the first outside curved portion 46*a* and the first inside curved portion 48*a* within the peripheral region AF. Furthermore, a distance lip between the first outside curved portion 46*p* and the first inside curved portion 48*p* within the extended region PF is formed to be shorter than a distance I1*a* between the first outside curved portion 46*a* and the first inside curved portion 48*a* within the peripheral region AF. Consequently, in the case that a length Lip of the first inclined portion 42*p* in the extended region PF and a length L1*a* of the first inclined portion 42*a* in the peripheral region AF are compared, the inequality L1*p*<L1*a* is satisfied.

In the first drawn stepped portion 40 which is formed in the manner described above, the first outside curved portion 46*p* of the extended region PF and the vicinity thereof extend to the outer side of the main body portion 14 with respect to the first outside curved portion 46*a* of the peripheral region AF. Further, the first drawn stepped portion 40 exhibits a shape in which the first parallel portion 44*p* within the extended region PF is slightly recessed with respect to the first parallel portion 44*a* within the peripheral region AF.

Figure 5:
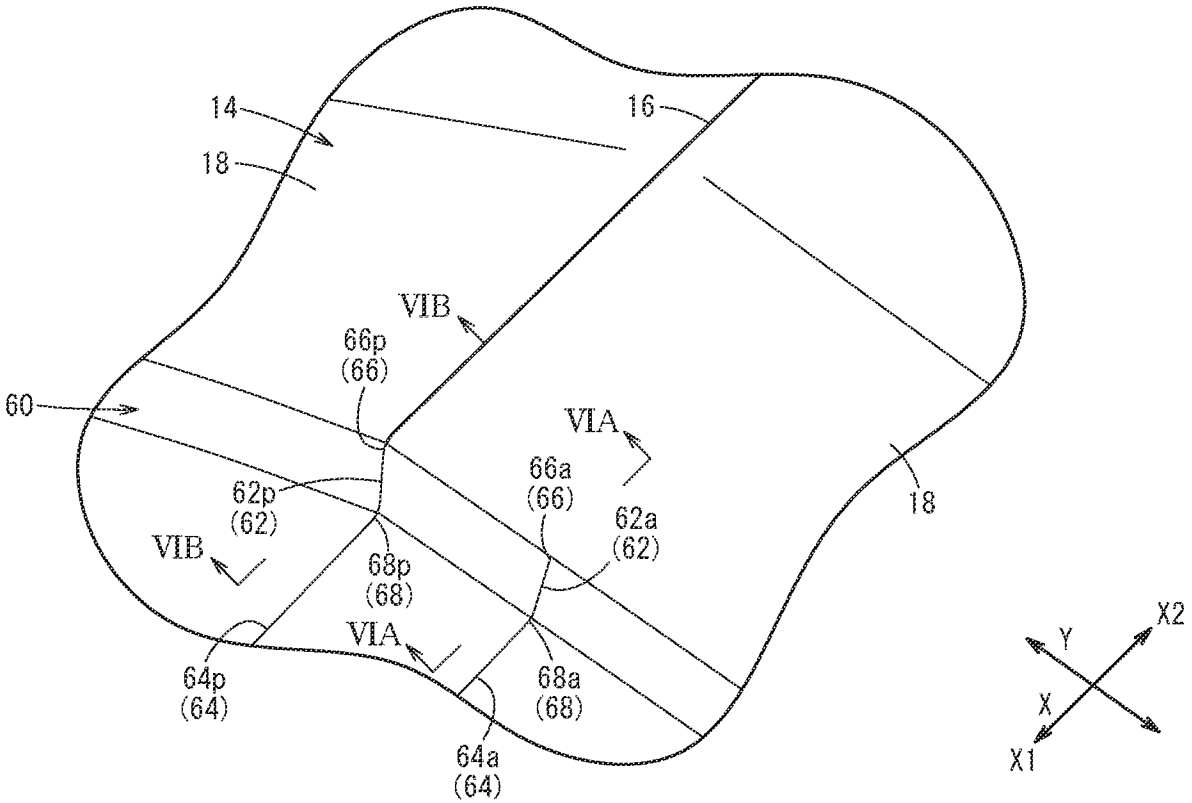
FIG. 5 is a perspective view showing a second drawn step portion formed by a second drawing step.
Figure 6A:
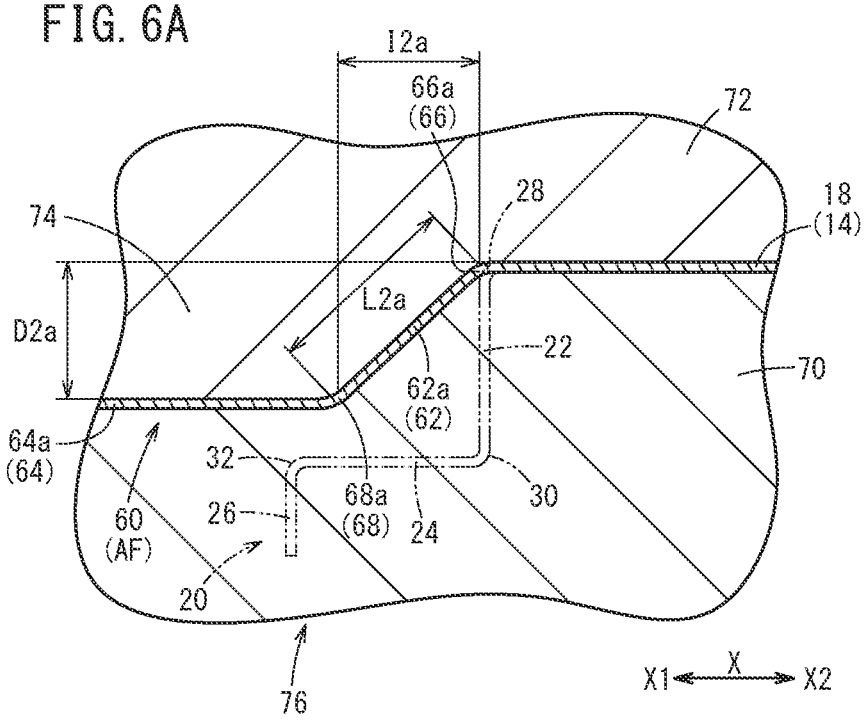
FIG. 6A is a cross-sectional view showing the second drawing step corresponding to a peripheral region taken along line VIA-VIA of FIG. 5.
Figure 6B:
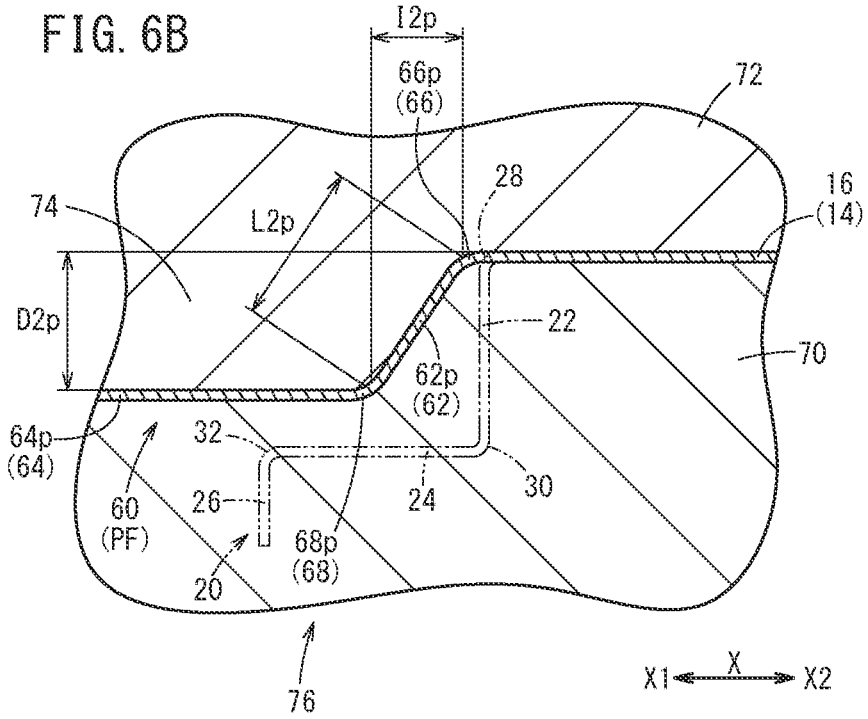
FIG. 6B is a cross-sectional view showing the second drawing step corresponding to an extended region taken along line VIB-VIB of FIG. 5.

In the second drawing step after the first drawing step, as shown in FIGS. 5, 6A, and 6B, the second drawn stepped portion 60 is formed by further subjecting, to a drawing process, the first drawn stepped portion 40 connected to the main body portion 14. The second drawn stepped portion 60 is formed in a manner so that a second inclined portion 62 is continuous with the outer periphery of the main body portion 14, and a second parallel portion 64 is continuous with an outer periphery of the second inclined portion 62. A second outside curved portion 66 having a curvature sufficiently smaller than the curvature of the outside corner portion 28 of the stepped portion 20 in its completed form is formed between the outer periphery of the main body portion 14 and an inner periphery of the second inclined portion 62. Similarly, a second inside curved portion 68 having a curvature sufficiently smaller than the curvature of the inside inner peripheral corner portion 30 of the stepped portion 20 in its completed form is formed between the outer periphery of the second inclined portion 62 and an inner periphery of the second parallel portion 64.

More specifically, in the second drawing step, the intermediate formed body (workpiece) having the first drawn stepped portion 40 is transported to a manufacturing device 76 for second drawing, and draw forming is carried out by the manufacturing device 76 for second drawing. In a similar manner to the manufacturing device 56 for first drawing, the manufacturing device 76 for second drawing includes a punch 70 that supports a rear surface side of the main body portion 14, a die 72 that restrains a front surface side of the workpiece (the main body portion 14), and a convex die portion 74 for forming the second parallel portion 64 by pressing on the workpiece. Moreover, although illustration thereof is omitted, the workpiece, at a location on a side opposite to the main body portion 14 with the convex die portion 74 sandwiched therebetween, is also sandwiched between a die and a punch that are not illustrated. In addition, in the second drawing step as well, by appropriately designing the planar shapes of the punch 70, the die 72, and the convex die portion 74, and the amount at which the convex die portion 74 protrudes, forming is performed so that, in the extended region PF and the peripheral region AF, the cross sections thereof along the direction of the arrow X differ from each other.

More specifically, a second outside curved portion 66*a* of the peripheral region AF is formed at substantially the same position as the outside corner portion 28 of the finished stepped portion 20. Due to the second outside curved portion 66*a*, the angle of inclination of a second inclined portion 62*a* with respect to the main body portion 14 is set to be larger than the angle of inclination of the first inclined portion 42*a* in the first drawing step. A second inside curved portion 68*a* of the peripheral region AF is formed to be slightly closer to the side of the arrow X2 than the inside outer peripheral corner portion 32 of the stepped portion 20 in its completed form. A drawing depth D2*a* of a second parallel portion 64*a* with respect to the smooth surface portions 18 (the main body portion 14) is made deeper than the drawing depth D1*a* of the first parallel portion 44*a* in the first drawing step.

On the other hand, a second outside curved portion 66*p* of the extended region PF is formed at substantially the same position as the outside corner portion 28 of the finished stepped portion 20. More specifically, the first outside curved portion 46*p* formed by the first drawing step is positioned more on the side of the arrow X1 than the second outside curved portion 66*p* formed by the second drawing step. Accordingly, the vicinity of the first outside curved portion 46*p* where the plate material of the workpiece is stretched in the first drawing step, and the vicinity of the second outside curved portion 66*p* where the plate material is stretched in the second drawing step are shifted from each other.

Further, the curvature of the second outside curved portion 66*p* is formed to be larger than the curvature of the first outside curved portion 46*p* of the first drawing step. Due to the second outside curved portion 66*p*, the angle of inclination of a second inclined portion 62*p* with respect to the main body portion 14 is also set to be larger than the angle of inclination of the second inclined portion 62*a* of the peripheral region AF.

Furthermore, a second inside curved portion 68*p* of the extended region PF is positioned more on the side of the arrow X2 than the inside outer peripheral corner portion 32 of the stepped portion 20 in its completed form. A drawing depth D2*p* of a second parallel portion 64*p* with respect to the character line 16 (the main body portion 14) is made slightly deeper than the drawing depth D2*a* of the second parallel portion 64*a* of the peripheral region AF.

Further, the curvatures of the second outside curved portion 66*p* and the second inside curved portion 68*p* within the extended region PF are formed to be smaller than the curvatures of the second outside curved portion 66*a* and the second inside curved portion 68*a* within the peripheral region AF. Furthermore, a distance I2*p* between the second outside curved portion 66*p* and the second inside curved portion 68*p* within the extended region PF is set to be shorter than a distance I2*a* between the second outside curved portion 66*a* and the second inside curved portion 68*a* within the peripheral region AF. In addition, in the case that a length L2*p* of the second inclined portion 62*p* in the extended region PF and a length L2*a* of the second inclined portion 62*a* in the peripheral region AF are compared, the inequality L2*p*<L2*a* is satisfied.

Returning to FIG. 2, in the trimming step after the second drawing step, the outer periphery of the second drawn stepped portion 60 is cut off in order to match with the size of the above-described stepped portion 20. More specifically, the second parallel portion 64 of the second drawn stepped portion 60 protrudes to the outer side at a length which is longer than the stepped portion 20 in its completed form, and by cutting the outer side of the second parallel portion 64 in the trimming step, a trimmed formed product is obtained with dimensions corresponding to those of the stepped portion 20 in its completed form (dimensions taking into consideration the forming of the second orthogonal portion 26).

Then, in the finishing step after the trimming step, by placing the trimmed formed product on a non-illustrated pressing device, and carrying out press forming (bending or the like), the stepped portion 20 is formed.

The press forming method according to the present embodiment is basically configured in the manner described above. Next, operations thereof will be described below.

In the press forming method, as shown in FIG. 2, the first drawing step, the second drawing step, the trimming step, and the finishing step are sequentially performed, to thereby form the main body portion 14 having the character line 16, together with simultaneously forming the stepped portion 20 at the front end of the main body portion 14.

As shown in FIGS. 4A and 6A, in the first drawing step, the first outside curved portion 46*a* is formed in the peripheral region AF at substantially the same position as the second outside curved portion 66*a* in the peripheral region AF in the second drawing step. Further, in the first drawing step, the first parallel portion 44*a* having the drawing depth D1*a* which is shallower than the drawing depth D2*a* of the second parallel portion 64*a* is formed. The length L1*a* of the first inclined portion 42*a* is shorter than the length L2*a* of the second inclined portion 62*a*. Thus, the portion connected to the smooth surface portions 18 of the main body portion 14 is processed into the same shape as in the first drawing step when the normal stepped portion 20 is manufactured.

Figure 7A:
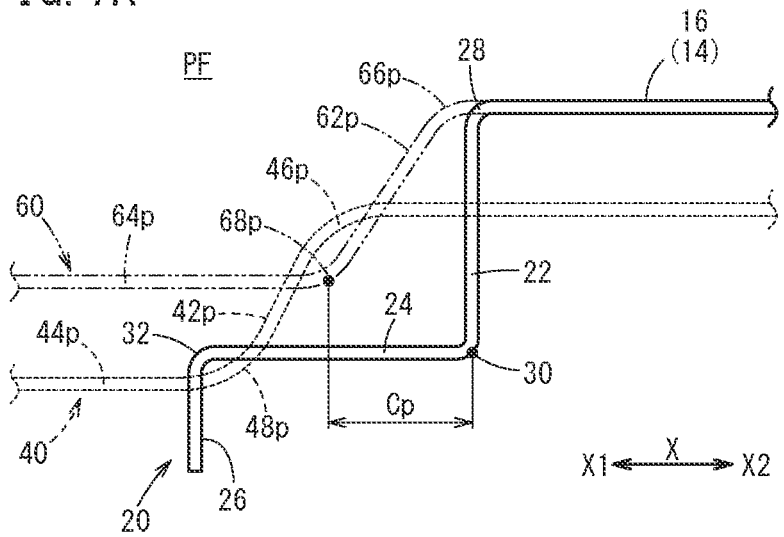
FIG. 7A is a cross-sectional view in which the first and second drawn stepped portions of the extended region and the stepped portion are shown.

On the other hand, as shown in FIGS. 4B and 7A, during the first drawing step, the first outside curved portion 46*p* is formed in the extended region PF on a more outer side (the side of the arrow X1) than the second outside curved portion 66*p* in the extended region PF in the second drawing step. Further, during the first drawing step, the first parallel portion 44*p* of the extended region PF is formed at the same depth as the drawing depth D2*p* of the second parallel portion 64*p* in the second drawing step. More specifically, the first parallel portion 44*p* is formed at a depth equal to or less than the depth of the stepped portion 20 in its completed form, and the length Lip of the first inclined portion 42*p* is approximated to the length L2*p* of the second inclined portion 62*p*.

Specifically, in the extended region PF in the first drawing step, the plate material in the vicinity of the first outside curved portion 46*p* having a small curvature is stretched, and the second parallel portion 64*p* is punched to a position in close proximity to the parallel portion 24 of the stepped portion 20. Consequently, the plate thickness in the vicinity of the first outside curved portion 46*p* at a position shifted toward the outer side from the outside corner portion 28 of the stepped portion 20 in its completed form is gradually made thinner (decreased) along a planar direction.

Further, in the second drawing step after the first drawing step, in the peripheral region AF connected to the smooth surface portions 18 of the main body portion 14 shown in FIG. 6A, processing is performed to obtain the same shape as in the second drawing step when the normal stepped portion 20 is manufactured. Stated otherwise, in the peripheral region AF, the second outside curved portion 66*a* is formed at substantially the same position as the outside corner portion 28 of the stepped portion 20 in its completed form, and further, the second parallel portion 64*a* is formed at a depth approximated to that of the parallel portion 24 of the stepped portion 20 in its completed form.

On the other hand, as shown in FIGS. 6B and 7A, in the extended region PF in the second drawing step, the second outside curved portion 66*p* is formed by being shifted toward the inner side (the side of the arrow X2) from the first outside curved portion 46*p*. Further, in the second drawing step, in the extended region PF, the second inside curved portion 68*p* is positioned on a more inner side (the side of the arrow X2) than the first inside curved portion 48*p* in the first drawing step, and is formed so as to have a curvature greater than that of the first inside curved portion 48*p*.

Therefore, during the second drawing step, in the extended region PF, the plate material in the vicinity of the second outside curved portion 66*p* on a more inner side than the first outside curved portion 46*p* in the first drawing step is stretched. Accordingly, the plate material that constitutes the stepped portion 20 is stretched at different locations in the first drawing step and the second drawing step, and it is possible to prevent the specified location of the plate material from being intensively stretched. Therefore, in the stepped portion 20, the occurrence of cracking in the extended region PF is suppressed.

Figure 7B:
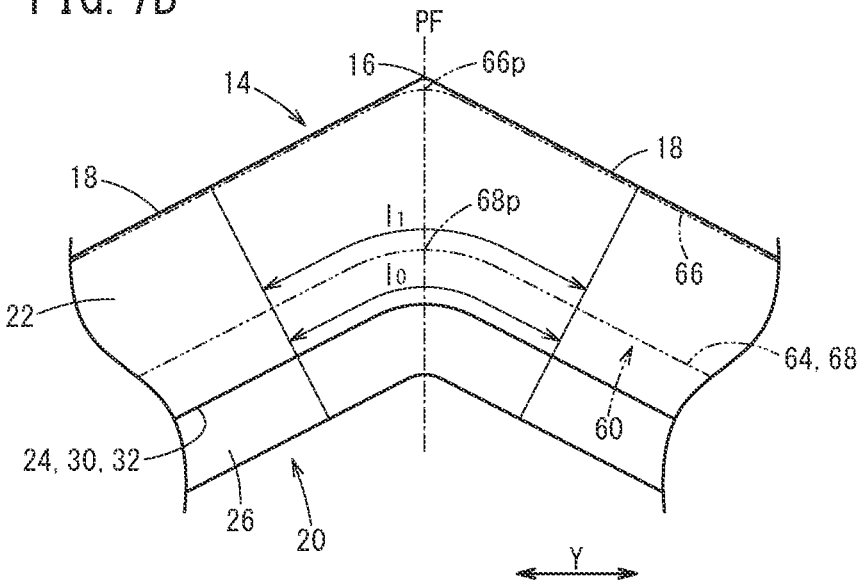
FIG. 7B is a schematic view in which a direction of an arrow X2 is observed from the side of an arrow X1 of FIG. 7A.

Further, as shown in FIGS. 7A and 7B, the second inside curved portion 68*p* in the second drawing step is positioned in close proximity to the inside inner peripheral corner portion 30 of the stepped portion 20 in its completed form (at an interval Cp which is shorter than an interval between the second inside curved portion 68*a* of the peripheral region AF and the inside inner peripheral corner portion 30 of the stepped portion 20 in its completed form). More specifically, in the case that a peripheral length around the periphery of the second inside curved portion 68*p* of the extended region PF is defined by $l_1$, and a peripheral length around the periphery of the inside inner peripheral corner portion 30 of the stepped portion 20 in its completed form is defined by $l_0$, the peripheral length $l_1$ and the peripheral length $l_0$ have a similar dimension (there is almost no difference between the peripheral lengths). Moreover, the periphery of the second inside curved portion 68*p* of the extended region PF and the periphery of the inside inner peripheral corner portion 30 refer to a range within which the stepped portion 20 is formed in a curved manner by the character line 16 of the main body portion 14.

In this instance, in the case that a linear shrinkage ratio S in the extended region PF is expressed by the following formula (1), the linear shrinkage ratio S in the extended region PF of the present embodiment becomes sufficiently smaller than that which takes place in normal press forming (for example, the linear shrinkage ratio S of the peripheral region AF).

$$S=(l_1-l_0)/l_0 \quad (1)$$

Due to the linear shrinkage ratio S of the extended region PF being made small in this manner, when the stepped portion 20 in its completed form is formed from the second drawn stepped portion 60 (a trimmed formed product after the trimming step) in the finishing step, it is possible to prevent the plate material from being gathered insofar as possible. Therefore, in the stepped portion 20, the occurrence of wrinkles in the extended region PF is suppressed.

The present invention is not limited to the embodiment described above, and various modifications are possible in accordance with the essence and gist of the invention. For example, the press forming method is not limited to manufacturing of the outer panel 10 of a rear door, and it is a matter of course that the method can be applied to various types of formed products having the character line 16 and the stepped portion 20.

Technical concepts and effects that are capable of being grasped from the above-described embodiment will be mentioned below.

In the press forming method, by carrying out the first and second drawing steps, even at the end part of the main body portion 14 having the character line 16, the stepped portion 20 can be satisfactorily formed without causing wrinkles or cracking to occur. Stated otherwise, since the position of the first outside curved portion 46*p* formed in the first drawing step, and the position the second outside curved portion 66*p* formed in the second drawing step are shifted, it is possible to prevent a specified location of the plate material from becoming extremely thin in the extended region PF. Therefore, occurrence of cracking in the extended region PF is suppressed. Further, the first parallel portion 44*p* formed in the first drawing step is formed at the same depth as the second parallel portion 64*p*, and the curvature of the second inside curved portion 68*p* is formed with a large curvature in the second drawing step, whereby the second inside curved portion 68*p* can be made closer to the stepped portion 20 in its completed form. Thus, in the finishing step, shrinkage of the second inside curved portion 68*p* becomes small, and the occurrence of wrinkles in the extended region PF is suppressed. Consequently, the press forming method is capable of significantly improving yield at the time of manufacturing.

Further, in the first drawing step, in the peripheral region AF positioned at a periphery of a direction orthogonal to the extending direction of the character line 16 (intermediate ridgeline), the first outside curved portion 46*a* is formed at the same position as the second outside curved portion 66*a*, and the first parallel portion 44*a* is formed at a shallower depth than the drawing depth D2*a* of the second parallel portion 64*a*. In accordance with such features, in the peripheral region AF positioned at the periphery of the extended region PF, the stepped portion 20 can be formed in a stable manner by gradually making the shape closer to that of the stepped portion 20 by a two stage drawing process.

Further, the first outside curved portion 46*p* of the extended region PF is formed on a more outer side than the first outside curved portion 46*a* of the peripheral region AF. In accordance with this feature, in the first drawing step, the extended region PF (in close proximity to the first outside curved portion 46*p*) extends more outward than the peripheral region AF, and the shape of the main body portion 14 having the character line 16 (intermediate ridgeline) is prevented from being destroyed.

Further, in the finishing step, the outside corner portion 28 in the stepped portion 20 is formed at the position of the second outside curved portion 66*p*, and the inside inner peripheral corner portion 30 in the stepped portion 20 is formed at the position of the second inside curved portion 68*p*, and the interval Cp between the second inside curved portion 68*p* of the extended region PF and the inside inner peripheral corner portion 30 is shorter than the interval between the second inside curved portion 68*a* of the peripheral region AF and the inside inner peripheral corner portion 30. In accordance with such features, shrinkage of the extended region PF in the second drawing step can be further suppressed, and the occurrence of wrinkles in the stepped portion 20 can be more reliably suppressed.

Further, in the second drawing step, the second inside curved portion 68*p* of the extended region PF is moved to a more inner side than the first inside curved portion 48*p* in the first drawing step. In accordance with this feature, in the second drawing step, it is possible to come closer to the shape of the stepped portion 20 in its completed form while suppressing elongation of the plate material in the vicinity of the second inside curved portion 68*p* of the extended region PF.

Further, the stepped portion 20 is disposed at a front end part of the outer panel 10 that makes up the rear door of an automobile. In accordance with this feature, even if the outer panel 10 constituting the rear door includes the character line 16, the stepped portion 20, which overlaps with the boundary or edge portion of the front door on the front end part, is formed with a satisfactory appearance.

What is claimed is:

1. A press forming method for forming a stepped portion on an end part of a main body portion including a character line, the press forming method comprising:

a first drawing step of forming, by a first drawing process, a first drawn stepped portion from a workpiece including the character line, the first drawn stepped portion including a first inclined portion connected to the main body portion via a first outside curved portion, and a first parallel portion connected to the first inclined portion via a first inside curved portion and extending in parallel with the main body portion;

after the first drawing step, a second drawing step of forming, by a second drawing process, a second drawn stepped portion from the first drawn stepped portion, the second drawn stepped portion including a second inclined portion connected to the main body portion via a second outside curved portion, and a second parallel portion connected to the second inclined portion via a second inside curved portion and extending in parallel with the main body portion; and after the second drawing step, a finishing step of finishing the stepped portion, wherein in the first drawing step, in an extended region positioned on an extension line of the character line, the first outside curved portion is formed on a more outer side than the second outside curved portion, and the first parallel portion is formed at a same depth as a drawing depth of the second parallel portion, and in the second drawing step, the second inside curved portion having a greater curvature than that of the first inside curved portion is formed in the extended region.

2. The press forming method according to claim 1, wherein, in the second drawing step, the second inside curved portion of the extended region is moved to a more inner side than the first inside curved portion in the first drawing step.

3. The press forming method according to claim 1, wherein the stepped portion is disposed at a front end part of an outer panel that makes up a rear door of an automobile.

4. The press forming method according to claim 1, wherein, in the first drawing step, in a peripheral region positioned at a periphery of a direction orthogonal to an extending direction of the character line, the first outside curved portion is formed at a same position as the second outside curved portion, and the first parallel portion is formed at a shallower depth than the drawing depth of the second parallel portion.

5. The press forming method according to claim 4, wherein the first outside curved portion of the extended region is formed on a more outer side than the first outside curved portion of the peripheral region.

6. The press forming method according to claim 4, wherein in the finishing step, an outside corner portion in the stepped portion is formed at a position of the second outside curved portion, and an inside inner peripheral corner portion in the stepped portion is formed at a position of the second inside curved portion, and an interval between the second inside curved portion of the extended region and the inside inner peripheral corner portion is shorter than an interval between the second inside curved portion of the peripheral region and the inside inner peripheral corner portion.

* * * * *